US007316070B2

(12) United States Patent
Green

(10) Patent No.: US 7,316,070 B2
(45) Date of Patent: Jan. 8, 2008

(54) SELF-RETRACTING UTILITY KNIFE

(75) Inventor: Matthew C. Green, Amherst, MA (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 11/274,524

(22) Filed: Nov. 15, 2005

(65) Prior Publication Data

US 2007/0107232 A1 May 17, 2007

(51) Int. Cl.
*B26B 1/08* (2006.01)

(52) U.S. Cl. ..... 30/162; 30/2; 30/335

(58) Field of Classification Search ..... 30/2, 30/162, 125, 330, 331, 335
See application file for complete search history.

(56) References Cited

U.S. PATENT DOCUMENTS

| | | | | |
|---|---|---|---|---|
| 3,107,426 | A | 10/1963 | Robinson, Jr. | |
| 3,604,113 | A * | 9/1971 | Cuscovitch | 30/331 |
| 4,393,587 | A * | 7/1983 | Kloosterman | 30/162 |
| 4,683,656 | A | 8/1987 | Peyrot et al. | |
| 4,769,912 | A | 9/1988 | Davis | |
| 4,803,782 | A * | 2/1989 | Lok | 30/294 |
| 4,805,304 | A | 2/1989 | Knoop | |
| 4,835,865 | A | 6/1989 | Knoop | |
| 4,868,985 | A | 9/1989 | Rehm | |
| 4,897,920 | A | 2/1990 | Dunbar | |
| 4,899,443 | A | 2/1990 | Beermann | |
| 5,012,581 | A | 5/1991 | Fletcher et al. | |
| 5,203,085 | A | 4/1993 | Berns | |
| 5,301,428 | A * | 4/1994 | Wilcox | 30/162 |
| 5,303,474 | A | 4/1994 | Keklak et al. | |
| 5,370,654 | A | 12/1994 | Abidin et al. | |
| 5,384,963 | A | 1/1995 | Beermann | |
| 5,423,843 | A | 6/1995 | Werner | |
| 5,426,855 | A | 6/1995 | Keklak et al. | |
| 5,545,175 | A | 8/1996 | Abidin et al. | |
| 5,569,282 | A | 10/1996 | Werner | |

(Continued)

FOREIGN PATENT DOCUMENTS

| | | |
|---|---|---|
| CA | 1332784 | 11/1994 |

(Continued)

*Primary Examiner*—Hwei-Siu C. Payer
(74) *Attorney, Agent, or Firm*—McCarter & English, LLP

(57) ABSTRACT

A utility knife includes a housing and a blade carrier movably mounted to the housing. The blade carrier includes a blade supporting surface for supporting a blade, wherein the blade carrier is movable between a retracted position with at least a substantial portion of the blade retracted in the housing, and a first extended position with at least a portion of the blade extending outwardly of the housing. An actuator is operably connected to the blade carrier and is operable to move the blade carrier between the retracted and extended positions to, in turn, move a blade located on the blade carrier between the retracted and extended positions. A biasing member biases the blade carrier toward the retracted position. A stop member is movable between a first position and a second position. In the first position, the stop member is engagable with the blade carrier to thereby limit extension of the blade carrier and blade located thereon to a second extended position spaced inwardly on the housing relative to the first extended position. In the second position of the stop member, the stop member is spaced away from the blade carrier to thereby permit movement of the blade carrier and blade located thereon to the first extended position.

21 Claims, 5 Drawing Sheets

U.S. PATENT DOCUMENTS

| | | | | |
|---|---|---|---|---|
| 5,581,890 | A | 12/1996 | Schmidt | |
| 5,617,635 | A | 4/1997 | Berns | |
| 5,749,886 | A | 5/1998 | Abidin et al. | |
| 5,768,787 | A | 6/1998 | Ireland | |
| 5,813,121 | A | 9/1998 | Gringer | |
| 6,044,562 | A | 4/2000 | Dillenbeck | |
| 6,058,607 | A | 5/2000 | Gringer | |
| 6,085,423 | A | 7/2000 | Marifone | |
| 6,148,520 | A | 11/2000 | Berns | |
| 6,161,290 | A | 12/2000 | Takamasa | |
| 6,219,923 | B1 | 4/2001 | Sinisi et al. | |
| 6,233,830 | B1 | 5/2001 | Lamond et al. | |
| 6,263,577 | B1 | 7/2001 | Wonderley | |
| 6,330,749 | B1 * | 12/2001 | Khachatoorian et al. | 30/162 |
| 6,418,624 | B1 | 7/2002 | Huang | |
| 6,438,849 | B1 | 8/2002 | Wonderley | |
| 6,438,850 | B2 | 8/2002 | Young et al. | |
| 6,487,778 | B1 | 12/2002 | Gringer et al. | |
| 6,516,520 | B1 | 2/2003 | Liao | |
| 6,553,673 | B2 | 4/2003 | Peyrot et al. | |
| 6,623,499 | B1 | 9/2003 | Andreini et al. | |
| 6,701,627 | B2 | 3/2004 | Korb et al. | |
| 6,775,911 | B2 | 8/2004 | Tremblay | |
| 6,785,966 | B2 | 9/2004 | Berns | |
| 6,813,833 | B2 | 11/2004 | Saunders et al. | |
| 6,832,438 | B1 | 12/2004 | Gringer et al. | |
| 6,907,668 | B2 | 6/2005 | Polei | |
| D508,839 | S | 8/2005 | Brown et al. | |
| D510,010 | S | 9/2005 | Brown et al. | |
| D511,288 | S | 11/2005 | Brown et al. | |
| 2002/0004985 | A1 | 1/2002 | Tabbi et al. | |
| 2002/0029482 | A1 | 3/2002 | Peyrot et al. | |
| 2003/0019332 | A1 | 1/2003 | Korb et al. | |
| 2003/0024123 | A1 | 2/2003 | Liao | |
| 2003/0084575 | A1 * | 5/2003 | Chen | 30/162 |
| 2003/0159290 | A1 * | 8/2003 | Berns | 30/2 |
| 2004/0045172 | A1 * | 3/2004 | Rowlay | 30/162 |
| 2004/0231162 | A1 | 11/2004 | Johnson et al. | |
| 2004/0237312 | A1 | 12/2004 | Hernandez et al. | |
| 2004/0244539 | A1 | 12/2004 | Korb et al. | |
| 2005/0188541 | A1 | 9/2005 | Brown et al. | |
| 2005/0193566 | A1 | 9/2005 | Brown et al. | |

FOREIGN PATENT DOCUMENTS

| | | |
|---|---|---|
| DE | 7207013 | 6/1972 |
| DE | 10323760 A1 | 12/2004 |
| EP | 0656247 B1 | 11/1994 |
| GB | 2169539 A | 7/1986 |
| WO | WO 95/00300 | 1/1995 |
| WO | WO 00/06345 | 2/2000 |

* cited by examiner

SELF-RETRACTING UTILITY KNIFE

FIELD OF THE INVENTION

The present invention relates to utility knives, and more particularly, to a utility knife that includes a blade carrier for selectively moving a utility knife blade between retracted and extended positions. The utility knife blade is normally retracted, and extends to a cutting position only when an operating actuator is manipulated and automatically returns to the retracted position upon release of the operating actuator.

BACKGROUND INFORMATION

Utility knives generally include a handle and at least one replaceable blade. Because such blades are known to become worn or damaged, utility knife handles generally include provisions to allow a blade to be removed from the handle, so that the blade may be reversed in the handle (in order to provide a new cutting edge for the knife) and/or replaced by another blade. In addition, utility knife handles generally include a blade carrier for supporting the blade and an actuator operably connected to the blade carrier to move the blade and blade carrier between retracted and extended positions.

In the case of many utility knives, the removal of a worn or damaged blade requires that the handle first be opened to gain access to the internal cavity inside the handle, in order to retrieve a spare blade that may be stored inside the handle. Unfortunately, upon opening the handle, the spare blades can fall out and become separated from the handle.

Some utility knife handles include a spare blade holder that releasably retains spare blades by engaging opposite surfaces of each blade with a pair of opposing clip members, and that orients the spare blade transversely relative to the cutting blade in the blade carrier. This arrangement tends to increase the width of the handle because of the spare blade orientation. In addition, it can be difficult to remove a spare blade from the opposing clip members because of the force required to remove it from the grasp of the opposing clip members, and because there is very little of the spare blade exposed rendering it cumbersome to grasp. Further, the number of spare blades that may be stored in such a holder is limited because each additional spare blade increases the thickness of the stacked spare blades, forces the opposing clip members further apart, and correspondingly increases the force applied to the blades by the opposing clip members. The increased force applied by the opposing clip members makes it difficult to add or remove a spare blade from the holder.

In most utility knives, the blade mounted for use is either immovably fixed, or is retractable into or extendable out of the handle. When the blade is constantly exposed, consequent risks of injury to people or objects nearby are possible while the knife is not in use. However, such risk of injury is prevented when the retractable blade is manually retracted into the handle.

To avoid the danger of an exposed blade when the utility knife is not in use, some prior art utility knives include arrangements in which the blade is self-retractable into the handle. Such self-retracting utility knife blades are continually biased towards the retracted position and into the handle using a retractable blade holder. In some such utility knives a toggle linkage is mounted between a fixed point in the handle and the blade holder. A spring normally biases the blade holder rearward, but the spring bias is overcome when one manually biases an operating actuator protruding from the handle, thereby extending the toggle linkage to in turn move the blade to an extended position. However, such prior art utility knives do not permit one to limit the extension of the blade as in an indexed blade carrier design, other than by only partially depressing the operating actuator, which can be awkward. For example, if one desired to extend the blade just enough to function as a box cutter, the user would have to maintain the blade in a position intermediate the fully retracted and extended positions, while working against a bias urging the blade into the retracted position. As a result, it can be difficult to maintain a constant extension of the blade. For example, it can be difficult to maintain a constant extension of the blade having the blade extend just enough to penetrate the box to cut therethrough, while also avoiding extension of the blade to an extent that might cause the blade tip to cut through material contained in the box.

Accordingly, it is an object of the present invention to overcome one or more of the above-described drawbacks or disadvantages of the prior art.

SUMMARY OF THE INVENTION

In accordance with a first aspect, the present invention is directed to a utility knife comprising a housing and a blade carrier movably mounted to the housing. The blade carrier includes a blade supporting surface for supporting a blade, wherein the blade carrier is movable between a retracted position with at least a substantial portion of the blade retracted in the housing, and a first extended position with at least a portion of the blade extending outwardly of the housing. An actuator is operably connected to the blade carrier and is operable to move the blade carrier between the retracted and extended positions to, in turn, move a blade located on the blade carrier between retracted and extended positions. A biasing member biases the blade carrier toward the retracted position. A stop member is movable between a first position and a second position. In the first position, the stop member is engagable with the blade carrier to thereby limit extension of the blade carrier and blade located thereon to the first extended position spaced inwardly on the housing relative to the second extended position. In the second position of the stop member, the stop member is spaced away from the blade carrier to thereby permit movement of the blade carrier and blade located thereon to the second extended position.

In some embodiments of the present invention, the utility knife includes a spare blade holder. The spare blade holder defines a mounting portion connectable to the housing for supporting the spare blade holder thereon, and a blade retaining portion extending from the mounting portion and overlying a cutting edge blade support portion of the housing. The blade retaining portion is flexible enough to allow it to be manually engaged and flexed away from the cutting edge blade support portion to, in turn, pass a back edge of a spare blade beneath the blade retaining portion with the respective cutting edge supported on the cutting edge blade support portion, and upon release, the blade retaining portion is biased into contact with the back edge of the blade to return the spare blade between the blade retaining portion and the cutting edge blade support portion. One or more spare blades can be received between the blade retaining portion and the cutting edge blade support portion.

In accordance with another aspect, the present invention is directed to a utility knife comprising a housing defining a blade aperture and first means for carrying a blade between a retracted position with the blade received within the blade aperture and a fully-extended position with a substantial portion of the blade extending outwardly of the blade aperture. The utility knife further includes second means movable between a first position for limiting translation of the first means and the blade carried thereon to a second extended position spaced inwardly on the housing relative to the fully-extended position, and a second position for allowing the first means and the blade to be moved to the fully-extended position. The utility knife further includes third means operably coupled to the first means for moving the first means between retracted and extended positions to, in turn, move a blade carried on the first means between retracted and extended positions. The utility knife further includes fourth means for biasing the blade carrier toward the retracted position.

In one embodiment of the present invention, the first means is a blade carrier, the second means is a stop member, the third means is an actuator, and the fourth means is a spring. Preferably, the stop member is engagable with at least one of the actuator, blade carrier and the blade to limit the extension of the blade through the blade aperture a distance corresponding to an extension of a box cutting blade.

In accordance with another aspect, the present invention is directed to a utility knife comprising a housing and a blade carrier movably mounted to the housing and including a blade supporting surface for supporting a blade. The blade carrier is movable between a retracted position with at least a substantial portion of the blade retracted in the housing, and at least one first extended position with at least a portion of the blade extending outwardly of the housing. An actuator is operably connected to the blade carrier and is operable to move the blade carrier between the retracted and extended positions to, in turn, move a blade located on the blade carrier between retracted and extended positions. A biasing member biases the blade carrier to the retracted position. A stop member is movable between (i) a first position engagable with the blade carrier and that limits extension of the blade to a second extended position which extends the blade from the housing less than in the at least one first extended position, and (ii) a second position spaced away from the blade carrier and that permits movement of the blade and the blade carrier to the at least one first extended position. A spare blade holder is connectable to the housing and is configured to receivably clip a cutting edge and an opposite back edge of each of a plurality of spare blades oriented obliquely relative to the blade located on the blade carrier.

One advantage of the present invention is that a single non-indexed actuator can be used to both move the blade carrier and blade between retracted and fully extended positions, as well as between retracted and less than fully extended positions corresponding to the extension of a typical box cutter. As a result, the utility knives of the present invention avoid the need for reliance on accurate finger pressure to ensure that the blade maintains an extension corresponding to extension of a box cutter.

Another advantage of a currently preferred embodiment of the present invention is that a spare blade holder is incorporated in the housing that allows retention of the blade via the cutting edge and back edge clipped in engagement with the spare blade holder as opposed to clipping opposite surfaces defining the body of each blade. In this manner, the spare blades are oriented obliquely relative to the cutting blade, thus allowing for a narrower handle.

These and other advantages will become more readily apparent in view of the following detailed description of the currently preferred embodiments of the present invention and accompanying drawings.

DETAILED DESCRIPTION OF PREFERRED EMBODIMENTS

Figure 1:
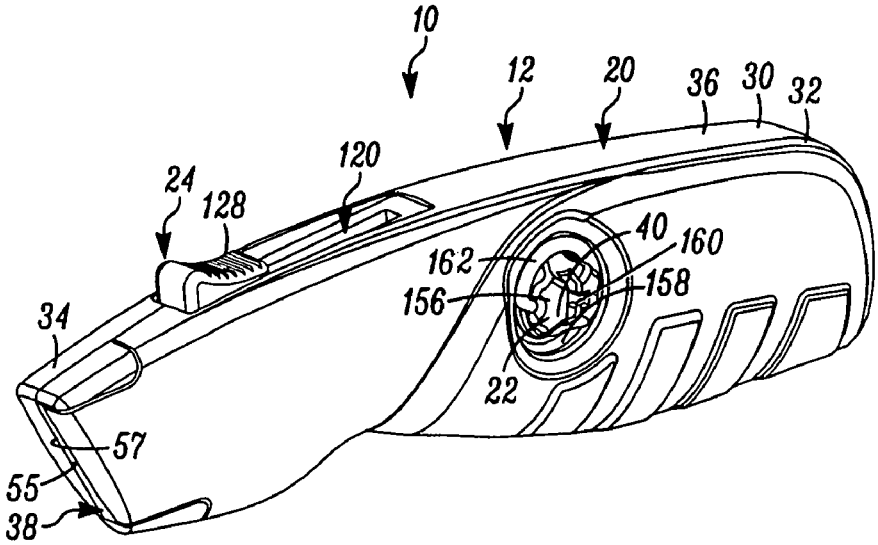
FIG. 1 is a front perspective view of an exemplary embodiment of a self-retracting utility knife of the present invention.

In FIG. 1, a utility knife embodying the present invention is indicated generally by the reference numeral 10. The utility knife 10 includes a handle 12, a blade 14 (FIGS. 2 and 5-8) and a spare blade holder assembly 16 for storing spare blades 18 (FIGS. 2, 3, and 5-8). The handle 12 includes a housing 20 defining a substantially internal cavity 21 (FIGS. 2-4), a mechanism 22 for releasably holding opposing portions of the housing 20 together, and an actuator 24 for moving the blade 14 between retracted and extended positions, and for releasing the blade 14 from the housing 20.

Figure 6:
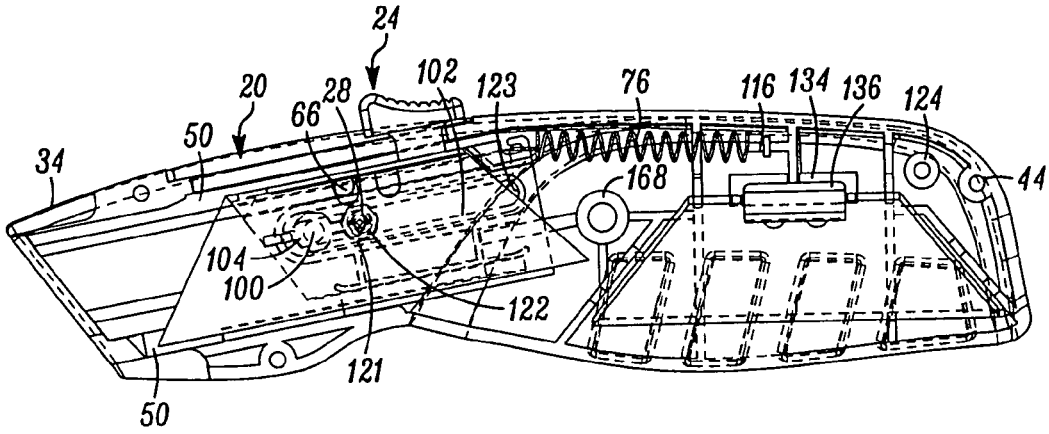
FIG. 6 is a side elevational view of the utility knife of FIG. 2 having a blade in the retracted position.
Figure 7:
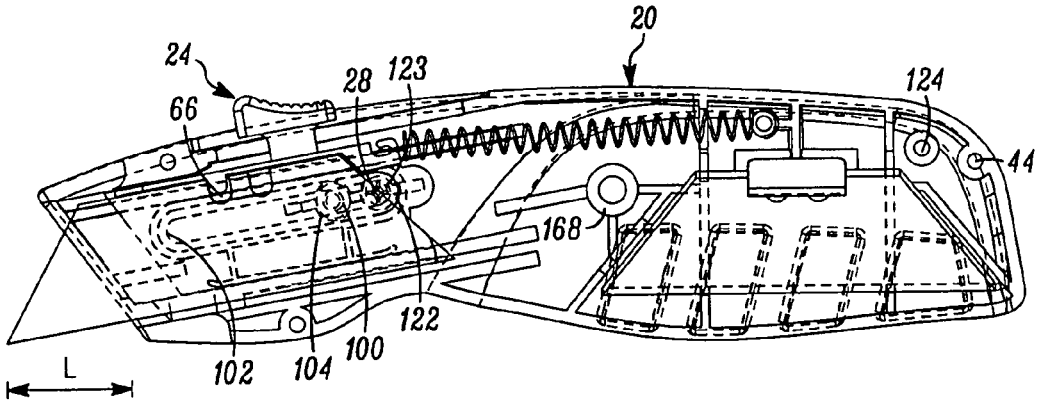
FIG. 7 is another side elevational view of the utility knife of FIG. 6 having the blade extended to a box cutter position.

As shown in FIGS. 2, 3, and 6-10, a blade carrier 26 supports thereon the blade 14 and is movably mounted within the housing 20 to move the blade between a retracted position with the blade received or concealed within the housing, and at least one, and preferably a plurality of, non-indexed extended positions with the cutting edge of the blade extending outwardly of the housing. As shown in FIGS. 6 and 7, a stop member 28 is slidably engageable with the blade carrier 26 and is fixedly mounted to the housing 20 at a first position substantially reducing travel of the blade carrier, and a second position (FIGS. 2, 3 and 8) spaced away from the blade carrier 26 permitting greater travel of the blade carrier 26. The actuator 24 is mounted on the blade carrier 26 and is operable to (1) move the blade carrier between the retracted and fully extended positions to, in turn, move the blade 14 located on the blade carrier between retracted and extended positions, and (2) move the blade carrier between the retracted and less than fully extended positions to, in turn, move the blade 14 located on the blade carrier between retracted and box cutting extended positions, depending if the stop member 28 is disposed in the first or second positions, respectively.

As shown typically in FIGS. 1-5, the housing 20 is formed of two separable portions 30, 32. Each of the first and second portions 30, 32 is made up of a nose portion 34 and a rear portion 36 disposed rearwardly of the nose portion 34. As shown in FIG. 1, the nose portion 34 of assembled portions 30, 32 defines a blade opening 38 at a first end of the handle 12 to receive the blade 14 therethrough. The second portion 32 is, to some extent, a mirror image of the first portion 30 and is removably connected thereto by, for example, a fastener (e.g., shown as a bail screw 40) disposed in a central portion of the housing 20.

Figure 3:
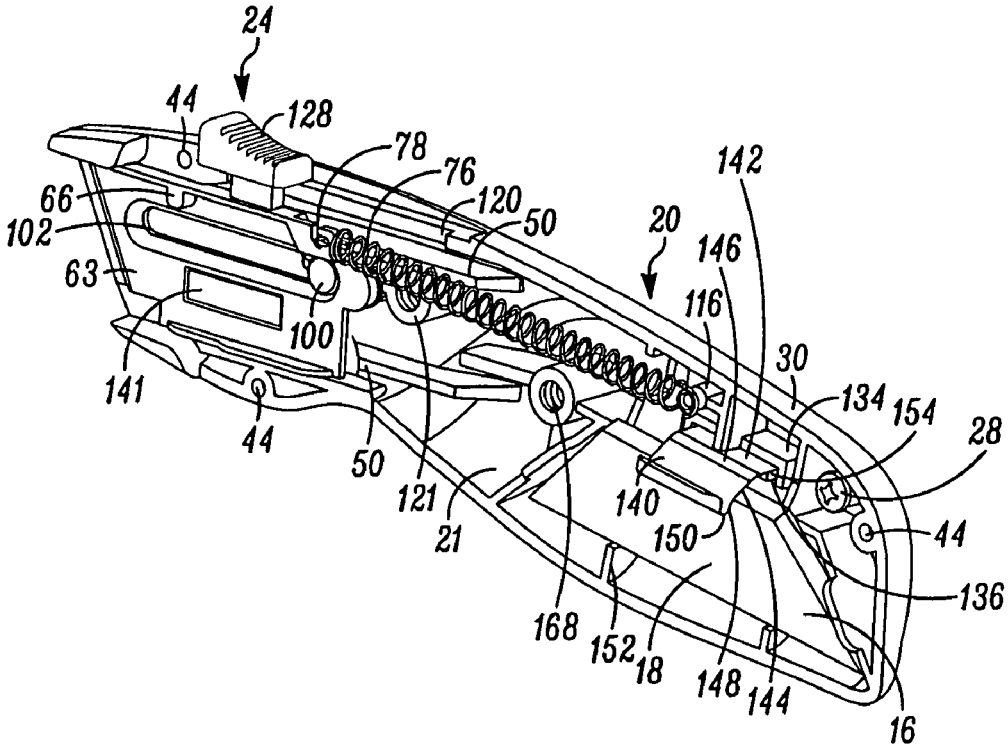
FIG. 3 is a rear perspective view of the utility knife of FIG. 2 without the blade in the blade carrier.
Figure 4:
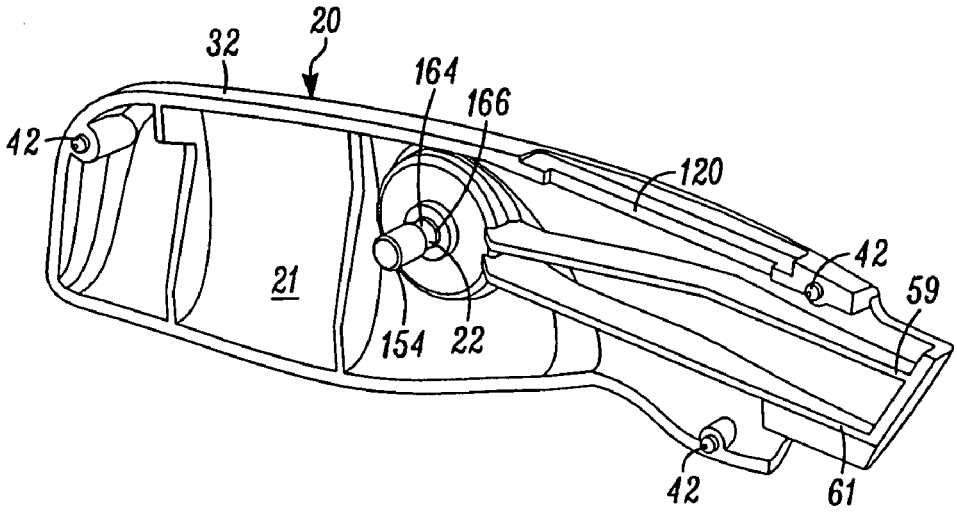
FIG. 4 is an opposite front perspective view of the handle cover of the utility knife of FIG. 1 illustrating a cavity defined inside the handle cover for accommodating spare blades.

As shown in FIG. 4, the second housing portion 32 includes a plurality of mounting bosses 42 that are received in complementary configured recesses 44 (FIGS. 2 and 3) for aligning the two portions 30, 32 of the housing 20 together during assembly thereof. The housing portions 30 and 32 may be formed in any manner, for example, but not limited to, by casting, machining, welding, and/or combinations thereof, and of any suitable material, for example, but not limited to, metal, plastic, and/or combinations thereof. Moreover, there is no requirement that the portions 30, 32 or 34, 36 be made of the same material. For example, if the portions 30, 32 are formed of metal, they may or may not be formed of the same metal. Indeed, in some preferred embodiments, the nose portion 34 may be formed of a metal (e.g., stainless steel) that is more wear resistant than the rear portion 36 of the first and second housing portions 30, 32 (e.g., aluminum), in order to increase the durability of the nose. This has the advantage that selected portion(s) of the housing 20 can be made more wear resistant than other portions, to improve the durability where needed, without the need to make the entire housing more wear resistant. Because higher wear resistant materials are often more expensive than less wear resistant materials, this approach provides an opportunity to improve durability, where needed, at lesser cost than would result from using higher wear resistant materials throughout the entire housing 20. Further details of materials used to form the nose portion 34 are disclosed in the following co-pending applications that are assigned to the assignee of the present invention and are hereby expressly incorporated by reference as part of the present disclosure: U.S. Provisional Patent Application Ser. No. 60/518,689, entitled "UTILITY KNIFE", filed on Nov. 10, 2003, U.S. Provisional Patent Application Ser. No. 60/518,690, entitled "Utility Knife with Actuator for Moving Blade Carrier and for Releasing Blade Therefrom, and Related Method", filed on Nov. 10, 2003, U.S. patent application Ser. No. 10/985,128, entitled "UTILITY KNIFE", filed on Nov. 9, 2004, and U.S. patent application Ser. No. 10/985,124, entitled "UTILITY KNIFE WITH ACTUATOR FOR MOVING BLADE CARRIER AND FOR RELEASING BLADE THEREFROM, AND RELATED METHOD", filed on Nov. 9, 2004. This patent application also discloses subject matter similar to that disclosed in the following co-pending patent applications, each of which also is hereby expressly incorporated by reference as part of the present disclosure: U.S. Design application Ser. No. 29/193,538, filed on Nov. 10, 2003, entitled "UTILITY KNIFE"; U.S. Design application Ser. No. 29/193,524, filed on Nov. 10, 2003, entitled "UTILITY KNIFE"; U.S. Design application Ser. No. 29/193,586, filed on Nov. 11, 2003, entitled "UTILITY KNIFE"; and U.S. Design application Ser. No. 29/193,585, filed on Nov. 11, 2003, entitled "UTILITY KNIFE".

As shown in FIG. 6, the nose 34 further defines an inner support surface 50 extending from inside the first housing portion 30 extending to the blade opening 38. The inner support surface 50 supports the blade carrier 26 when located in fully extended or retracted positions.

The first and second housing portions define the nose 34 when assembled together defining spaced apart opposing surfaces 55, 57 (FIG. 1) that define the blade opening 38 therebetween. The opposing surfaces 55, 57 each may be substantially planar and substantially parallel to one another, although this is not required. The two surfaces 55, 57 are separated by a distance that is selected, for example, to be large enough to allow the blade 14 to pass therebetween, yet small enough that the surfaces 55, 57 provide some lateral stability for the blade 14 during use, e.g., during cutting, sticking, etc. As shown in FIG. 4, the second housing portion 32 defines ribs 59, 61 that extend laterally therefrom along the path of blade movement to provide further lateral stability during use, and the blade carrier 26 defines a substantially planar blade supporting surface 63 (FIG. 3) that is spaced apart from, and faces the ribs 59, 61 when the blade carrier is located in extended positions. When the housing 20 is in a closed state, the ribs 59, 61 are spaced laterally from the blade supporting surface 63 of the blade carrier 26 a distance that is sufficiently wide to allow the blade 14 to fit therebetween, yet sufficiently narrow to prevent lateral movement of the blade 14 away from the blade supporting surface 63. As shown typically in FIG. 10, a peripheral rim 65 extends about two sides of the blade supporting surface 63 and is raised relative thereto for receiving the blade 14. As can be seen, the rim 65 substantially conforms to the peripheral shape of at least the back edge and cutting edge of the blade 14 corresponding to surfaces of the blade 14 seated therein to properly seat and orient the blade on the blade carrier.

Figure 9:
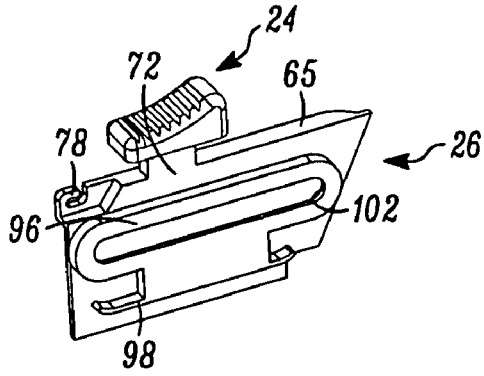
FIG. 9 is a front side perspective view of the blade carrier of the utility knife of FIG. 3.
Figure 10:
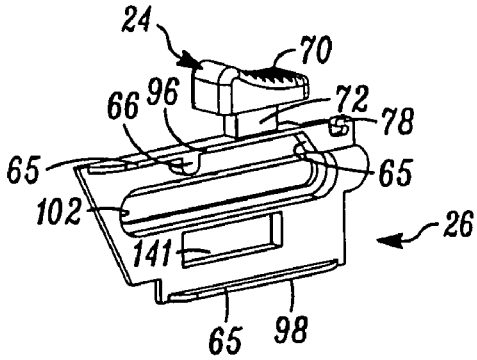
FIG. 10 is an opposite side perspective view of the blade carrier of FIG. 9.

As shown best in FIGS. 9 and 10, the actuator 24 includes a manually engageable thumb knob 70, and a shaft 72 extending downwardly from the knob and connected to rim 65 of the blade carrier 26. As best seen with reference to FIGS. 2, 3, 9 and 10, a coil spring 76 engages a first spring-engaging portion 78 formed on one end of the blade carrier 26 to bias the blade carrier toward the retracted position. The blade carrier 26 defines at least one blade-engaging boss 66 that extends from rim 65 formed in the blade carrier 26, and is received within a respective u-shaped aperture 94 (FIG. 2) formed in a blade 14 to releasably secure the blade to the blade carrier 26.

The blade carrier 26 defines upper and lower bearing surfaces 96 and 98, respectively (FIGS. 9 and 10), and as shown in FIG. 3, the rear portion 36 of the housing defines corresponding upper and lower bearing surfaces 50, respectively, for slidably contacting the bearing surfaces of the blade carrier upon moving the blade carrier between retracted and extended positions. As also shown in FIG. 3, a guide pin 100 is received in an axially elongated slot 102 configured in the blade carrier 26. One end of the guide pin is fixedly secured to the rear portion 36 of the housing while an opposite end includes a head 104 configured to slidably retain the blade carrier relative to the housing. The guide pin 100 is retained within the slot 102 by the head 104 (FIGS. 6-8) to secure the blade carrier to the housing 20 and guide the longitudinal movement thereof.

As shown in FIG. 3, the coil spring 76 is coupled between the actuator 24 and rear housing 36 to bias the actuator inwardly of the housing 20. The coil spring 76 is operably coupled at one end to the first spring-engaging portion 78 extending from the blade carrier 26, while an opposite end is operably coupled with a retaining clip 116 or second spring-engaging portion extending from the rear housing 36. As shown typically in FIG. 6, the coil spring 76 urges the first spring-engaging portion 78 of the actuator 24 away from the blade opening 38 to, in turn, urge the blade 14 into the housing 20. The retaining clip 116 fixedly secures an opposite end of the spring 76 at the rear portion of the housing 20 thereby providing a bias against outward movement of the blade carrier 26 toward the extended position.

As shown in FIGS. 1-4, the housing 20 defines an elongated actuator slot 120 formed between the first and second housing portions 30 and 32, respectively, for receiving the shaft 72 of actuator 24 and permitting the shaft 72 to move therethrough between retracted and extended positions. In the illustrated embodiment of the present invention, when the actuator 24 is located in the innermost position, the blade 14 seated on the blade carrier 26 is retracted within the housing. When the actuator 24 is located in any of the other non-indexed positions, the cutting edge of the blade 14 is exposed through the blade aperture 38 of the housing. Each of these non-indexed extended positions defines a different degree of exposure of the blade 14 through the blade aperture 38, wherein the innermost position defines no exposure of the blade, and the outermost position defines the greatest degree of exposure of the blade. The actuator 24 is moved through the slot 120 by engaging the knob 70 with a finger to bias the actuator outwardly and, in turn, overcome the bias of spring 76 on the blade carrier 26 to extend the blade 14 out through blade opening 38. By pushing the actuator to overcome the bias of spring 76, the user moves the actuator 24 forwards within the slot to the desired position. When the user then releases the actuator 24 from a selected position, the spring 76 urges the blade carrier and blade into the retracted position. It will be recognized that release of the actuator 24 may not result in retracting the blade 14 when the blade surfaces are frictionally engaged with a work piece being cut. The knob 70 of actuator 24 defines a manually engagable surface 128 formed on an upper side of the knob for moving the actuator 24 axially through the slot 120 between retracted and extended positions. As may be recognized by those of ordinary skill in the pertinent art based on the teachings herein, the utility knives of the present invention may define any desired number of different extended and/or retracted non-indexed positions of the blade.

As can be seen, the manually-engagable surface 128 defines an inner, substantially concave portion, and outer relatively flat portions located on either side of the inner concave portion. This surface contour facilitates depressing the knob 70 with a finger against the force of the spring 76 and moving the knob backwards and forwards within the slot 120 to, in turn, move the blade carrier 26 and blade 14 between retracted and extended positions.

Figure 8:
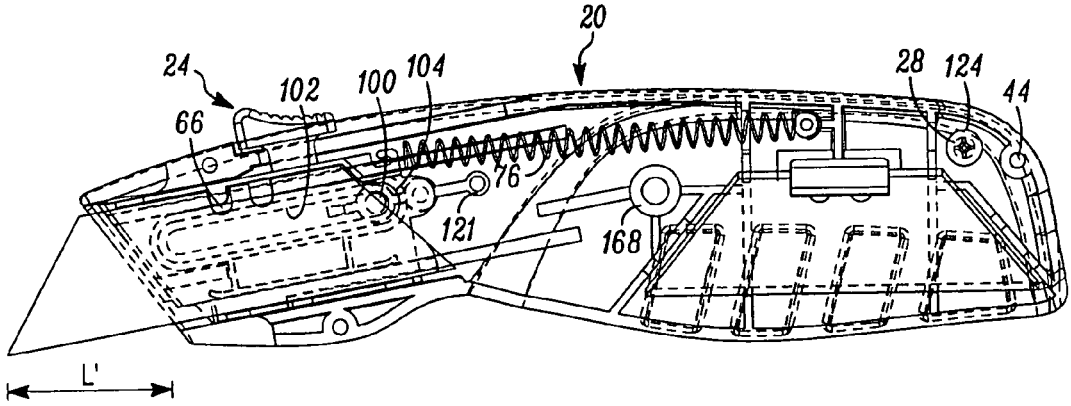
FIG. 8 is another side elevational view of the utility knife of FIG. 7 having the blade extended to a fully-extended position.

Referring now to FIGS. 6-8, the positioning of the stop member 28 between the first and second positions is described as they relate to allowing full extension of the blade 14 and extension of the blade only so far as to correspond to a box cutter, respectively. FIG. 6 illustrates the blade carrier 26 in a retracted position and illustrates the stop member 28 threadably disposed in a mounting boss 121 (FIG. 3) corresponding to a first position of the stop member 28, which corresponds to a box cutting position. In this exemplary embodiment, the stop member 28 is configured as a threaded fastener 28 (e.g., a screw) disposed in the elongated slot 102 and fixedly secured to the first housing portion 30 via the threaded mounting boss 121. The threaded fastener 28 includes a head 122 at one end guidably retained within the slot 102 and a threaded portion at the opposite end threaded into mounting boss 121. As shown in FIG. 7, the head 122 of the stop member 28 limits travel of the blade carrier 26 as the blade carrier 26 functions as a stop surface via an end portion 123 of slot 102 when the head 122 of fixed fastener 28 abuts the same. The fastener 28 in the first position, as illustrated in FIGS. 6 and 7, shortens a length of travel allowed by slot 102 compared to an absence of the fastener 28 disposed in boss 121. If the fastener 28 is removed from this first position, the head 104 of guide pin 100 would allow further extension of the blade carrier 26 until head 104 abuts the end portion 123 of slot 102. It should be noted that when the fastener 28 is disposed in the first position corresponding to a box cutting position, the fastener is removed from the second position indicated generally by a second threaded mounting boss 124.

In exemplary embodiments, a length L of the cutting edge of blade 14 exposed through blade aperture 38 is between about 0.18 inch and about 0.3 inch when the stop member 28 is in the first position as illustrated in FIG. 7 and the actuator is biased toward a fully extended position. However, other ranges of extensions are contemplated depending on any of numerous different factors including, for example, the selected blade used with the carrier 26.

Referring now to FIGS. 6-8, the positioning of the stop member 28 between the first and second positions is described as they relate to allowing full extension of the blade 14 and extension of the blade only so far as to correspond to a box cutter, respectively. FIG. 6 illustrates the blade carrier 26 in a retracted position and illustrates the stop member 28 threadably disposed in a mounting boss 121 (FIG. 3) corresponding to a first position of the stop member 28, which corresponds to a box cutting or a first position. In this exemplary embodiment, the stop member 28 is configured as a threaded fastener 28 (e.g., a screw) disposed in the elongated slot 102 and fixedly secured to the first housing portion 30 via the threaded mounting boss 121. The threaded fastener 28 includes a head 122 at one end guidably retained within the slot 102 and a threaded portion at the opposite end threaded into mounting boss 121. As shown in FIG. 7, the head 122 of the stop member 28 limits travel of the blade carrier 26 as the blade carrier 26 functions as a stop surface via an end portion 123 of slot 102 when the head 122 of fixed fastener 28 abuts the same. The fastener 28 in the first position, as illustrated in FIGS. 6 and 7, shortens a length of travel allowed by slot 102 compared to an absence of the fastener 28 disposed in boss 121. If the fastener 28 is removed from this first position, the head 104 of guide pin 100 would allow further extension of the blade carrier 26 until head 104 abuts the end portion 123 of slot 102. It should be noted that when the fastener 28 is disposed in the first position corresponding to the box cutting position, the fastener is removed from the second position indicated generally by a second threaded mounting boss 124.

In exemplary embodiments, a length L of the cutting edge of blade 14 exposed through blade aperture 38 is between about 0.18 inch and about 0.3 inch when the stop member 28 is in the first position as illustrated in FIG. 7 and the actuator is in the box cutting or first position. However, other ranges of extensions are contemplated depending on any of numerous different factors including, for example, the selected blade used with the carrier 26.

FIG. 8 illustrates the blade carrier 26 in a fully extended or second position and illustrates the stop member 28 threadably disposed in the second threaded mounting boss 124 corresponding to the second position of the stop member, which corresponds to allowing full extension of blade 14 as with a typical self-retracting knife blade. A length L' of the cutting edge of the blade 14 exposed through the blade aperture 38 is more than about 0.3 inch when the stop member 28 is in the second position and the actuator is biased toward the fully extended or second position.

In FIG. 8, the fastener 28 is removed from the first threaded mounting boss 121 and threadably received in the second threaded mounting boss 124 for storage of the fastener until the box cutting position or first position is desired. When the box cutting position is desired, the housing portions 30, 32 are pivotally opened or otherwise separated to gain access to the fastener. The fastener 28 is removed from the second boss 124, disposed through the elongated slot 102 and threadably received in the first boss 121 corresponding to the box cutting or first position.

Although the housing portions 30, 32 have been described as being separated for changing between the box cutting and second positions, it will be recognized by one skilled in the pertinent art that separation of the housing portions 30, 32 is not necessary. In addition, the stop member may take any of numerous different configurations, and/or may be located in any of numerous different positions on the housing or on components within the housing, that are currently known, or that later become known for performing the functions of the stop member as indicated herein. For example, the stop member 28 may extend outside housing 20 and thus be accessible without having to open housing 20. In one example, the stop member may be a pin or other member that interfaces a stop surface on one of the blade 14, blade carrier 26 or the actuator 24. In other embodiments, the stop member may be a pin that is translated into and out of a single boss corresponding to the first and second positions, respectively. In this manner, a second boss 124 is not necessary for receiving the stop member or pin in the second position.

Figure 2:
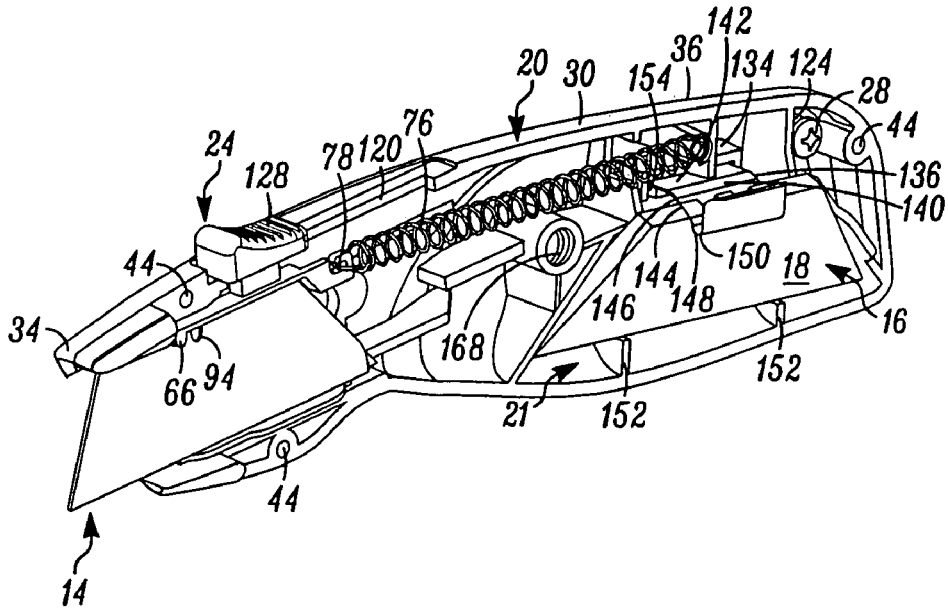
FIG. 2 is a front perspective view of the utility knife of FIG. 1 with the handle cover removed and illustrating blades in both the blade carrier and spare blade holder.
Figure 5:
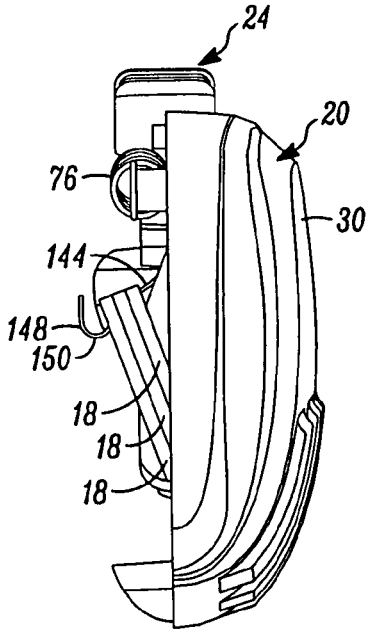
FIG. 5 is a back elevational view of the utility knife of FIG. 3.

As shown in FIGS. 2, 3 and 5, the spare blade holder assembly 16 includes a mount 134 formed on the first housing portion 30 and extending laterally therefrom. The mount 134 defines an elongated slot 136. The spare blade holder assembly 16 further comprises a spare blade holder 140 defining a mounting portion 142, a blade support portion 144, a first bend 146 formed between the mounting and blade support portions, and a blade retaining portion 148 extending from the blade support portion 144. The blade retaining portion 148 is defined with a rounded edge 150 to facilitate engagement with a back edge of a blade 18 received within the spare blade holder assembly 16. The spare blade holder assembly 16 further includes a pair of ribs 152 formed on the first housing portion 30 and extending laterally therefrom. The ribs 152 define a support surface for the cutting edges of the blades received within the spare blade holder assembly 16. In this manner, the blade support portion 144 is biased toward the ribs 152, such that a length between the cutting edge and back edge of the blade 18 is more than the length between the ribs 152 and a facing surface of the blade support portion 144 while in a free-standing state (e.g., no blades 18 disposed therebetween). The mounting portion 142 includes at least one protuberance 154 (FIG. 3) extending therefrom (two protuberances shown disposed on opposing ends) to be received within the elongated slot 136 of the mount 134 such that the protuberance 154 provides an interference fit of the mounting portion 142 within the mount 134 to secure the spare blade holder 140 in place. Each protuberance may be formed by stamping a portion defining either of the opposite major surfaces of the mounting portion 142 to provide a stamped portion that extends a distance from one of the major surfaces of the mounting portion. The distance that the protuberance extends from the surface is more than a width that defines the slot 136 to thereby provide an interference fit when the protuberance is disposed in the slot 136. As can be seen, when the mounting portion 142 is received within the mount 134, the mounting portion is oriented substantially perpendicular to the plane of the blade supporting surface 63 of the blade carrier 26 and of a blade 14 seated thereon. As shown generally in FIGS. 2 and 3 and particularly in FIG. 5, a plurality of spare blades 18 may be clipped between the ribs 152 supporting the cutting edges and the blade support portion 144 supporting the back edges, while the blade retaining portion 148 retains the back edge of the outermost or exposed blade. For example, it is contemplated that the spare blade holder 140 may hold as many as five spare blades 18, but is not limited thereto. In the illustrated embodiment, the spare blade holder 140 is formed of sheet metal, such as a spring steel, and the blade retaining portion 148 is biased toward the ribs 152 to secure the spare blades 18 received therebetween. The spare blade holder 140 also aligns the spare blades 18 obliquely with respect to a blade 14 secured to the blade carrier 26. In this manner, housing 20 may be made thinner, since the spare blades are not disposed perpendicularly to the blade 14 in the blade carrier 26. It will be recognized by one skilled in the pertinent art that the spare blade holder 140 does not need to be formed of sheet material. All that is important that the spare blade holder 140 be flexible enough to allow engagement of the blade therewith using a finger, to flex the blade retaining portion 148 upwardly while passing the back edge of the blade beneath it, and upon release, to flex inwardly enough to retain the blade in place.

For example, the spare blade holder 140 may be formed by cutting, stamping or otherwise forming a piece of flat sheet material, and then pressing or otherwise bending the flat sheet of material into the illustrated form. However, as my be recognized by those of ordinary skill in the pertinent art based on the teachings herein, the spare blade holder 140 may be made of any of numerous different materials in accordance with any of numerous different methods that are currently or later become known. For example, if desired, the spare blade holder 140 may be formed by molding a suitable plastic into the illustrated shape, or into another desired shape.

When the housing 32 is removed from housing 30 (FIGS. 2-4), the blade 14 may be released from the exposed blade carrier 26. The blade 14 is disengaged from the blade carrier 26 by disengaging the apertures 94 of the blade from the blade mounting boss 66. Then, the same blade 14 may be flipped to present the other side of the cutting edge for use, or a new blade may be installed. In either case, the blade 14 may be installed in the exposed blade carrier 26 and manipulated to align an aperture 94 with the mounting boss 66. Once the blade 14 is fully installed, the second housing portion 32 is reassembled with the first housing portion 30. In the illustrated embodiment as depicted in FIGS. 3, 9 and 10, the blade carrier 26 defines a recess and a magnet 141 fixedly mounted therein. Magnet 141 allows retention of the blade 14 with the blade carrier 26 and prevents accidental separation thereof when housing 20 is opened. The magnet 141 magnetically retains the blade 14 with the blade carrier until the blade is manually separated from the carrier.

As shown in FIGS. 1 and 4, the mechanism 22 for releasably fastening the two portions 30, 32 of the housing 20 includes the bail screw 40 that defines a manually operable threaded portion 154 (FIG. 4) that retains the second housing portion 32 with the first housing portion 30. As shown in FIG. 1, bail screw 40 includes a head 156 received in a recess 158 formed in an outside portion of the second housing portion. Head 156 includes a slot 160 configured to receive a complementary shaped tool to tighten and loosen the same. In an exemplary embodiment, the slot 160 includes a Phillips head profile (not shown) to receive a complementary sized Phillips head screwdriver, however, other tool head configurations are contemplated. The head 156 further includes a D-ring 162 pivotally mounted thereto to facilitate turning screw 40 without having to use a tool. The bail screw 40 includes a non-threaded shaft 164 intermediate the head 156 and threaded diameter 154. The non-threaded shaft 164 is disposed through an aperture 166 in the second housing portion 32 extending into cavity 21. The threaded diameter 154 has a larger diameter than a diameter of the non-threaded shaft and aperture in which it is disposed. In this manner, the bail screw 40 is retained with the second housing portion upon threadable disengagement with the first housing portion 30. The threaded diameter 154 of the bail screw 40 is received in a complementary threaded boss 168 extending from the first housing portion 30 (FIGS. 2 and 3).

The operation of the mechanism 22 is as follows. The D-ring 162 is pivoted out of recess 158 such that the D-ring 162 is substantially perpendicular to the blade 14. The D-ring 162 may then be manually turned to loosen or tighten the bail screw 40 to disassemble or assemble the housing portions 30, 32, respectively. When the housing portions are separated, the bail screw remains slidably and rotatably retained with the second housing portion 32.

If desired, the spare blade holder and other components of the utility knives of the present invention may be the same as, or similar to corresponding components described in the commonly assigned U.S. Patent Application entitled Utility Knife with Actuator for Moving Blade Carrier and for Releasing Blade Therefrom, and Related Method, filed on Nov. 10, 2004, accorded Ser. No. 10/985,124, and U.S. patent application entitled Utility Knife, filed on Nov. 9, 2004, accorded Ser. No. 10/985,128, both of which are expressly incorporated by reference as part of the present disclosure.

Figure 11:
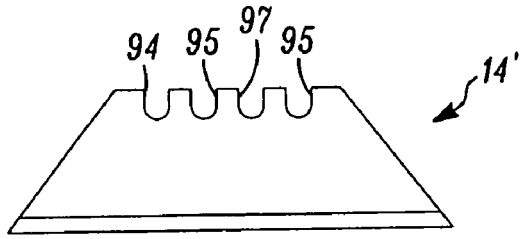
FIG. 11 is a side elevational view of a utility blade that is usable in the utility knives of the present invention and that includes four notches in the upper edge of the blade to provide two cutting positions on the blade carrier for each side of the cutting edge of the blade.

In FIG. 11, an alternative utility blade usable with the utility knives of the present invention is indicated generally by the reference numeral 14'. The primary difference of the utility blade 14' in comparison to the utility blade 14 described above, is that the utility blade 14' defines in its upper edge four notches or u-shaped apertures 94, 95, 97, 99. Accordingly, each side of the blade defines three cutting positions, a first cutting position with the blade-engaging boss 66 received within the second notch 95, and a second cutting position with the blade-engaging boss 66 received within the third notch 97 and a third cutting position with the respective blade-engaging boss 66 received within the fourth notch 99. It will be recognized by one skilled in the pertinent art that the fourth notch 99 assumes the position of the first notch 94 when the blade is flipped 180 degrees relative to an axis of symmetry of the blade 14'. In the illustrated embodiment, when the blade 14' is located in the first cutting position (using the second notch 95), about 46% of the cutting edge extends outwardly of the blade aperture 38 and is exposed for cutting in the fully-extended position of the carrier, while about 36% of the cutting edge extends outwardly of the blade aperture 38 and is exposed for cutting when in the box cutting position of the carrier. In the second cutting position (using the third notch 97), on the other hand, a lesser portion of the cutting edge extends outwardly of the blade aperture 38 in comparison to the first cutting position. In the illustrated embodiment, in the second cutting position, about 36% of the cutting edge extends outwardly of the blade aperture 38 and is exposed for cutting in the fully-extended position of the carrier, while 26% of the cutting edge extends outwardly of the blade aperture 38 and is exposed for cutting when in the box cutting position of the carrier. In the third cutting position (using the fourth notch 99), a lesser portion of the cutting edge extends outwardly of the blade aperture 38 in comparison to the first and second cutting positions. In the illustrated embodiment, in the third cutting position, about 26% of the cutting edge extends outwardly of the blade aperture 38 and is exposed for cutting in the fully-extended position of the carrier, while about 16% of the cutting edge extends outwardly of the blade aperture 38 and is exposed for cutting when in the box cutting position of the carrier. However, these percentages may vary depending on the particular handle within which the blade is mounted.

If desired, the blades 14 and 14' may be any of the different types of composite utility blades disclosed in the following patent and co-pending patent applications, which are assigned to the Assignee of the present invention and are hereby expressly incorporated by reference as part of the present disclosure: U.S. Pat. No. 6,701,627 issued Mar. 9, 2004, entitled "COMPOSITE UTILITY KNIFE BLADE AND METHOD OF MAKING SUCH A BLADE"; U.S. patent application Ser. No. 10/202,703 filed Jul. 24, 2002, entitled "Composite Utility Knife Blade and Method of Making Such a Blade"; and U.S. patent application Ser. No. 10/793,593 filed Mar. 4, 2004, entitled "COMPOSITE UTILITY BLADE AND METHOD OF MAKING SUCH A BLADE". One advantage of such composite utility blades is that they are bendable and virtually shatter-proof As a result, such blades are particularly well suited to defining four notches 94, 95, as opposed to only two notches as in conventional utility blades, because when located in the fully extended, second cutting position, such blades can be subjected to relatively high lateral forces and bending without shattering or otherwise breaking.

Although the housing is shown having two separable portions that are connected to one another via the mounting bosses 42, this is not a requirement. For example, the housing may be formed of any number of separate portions pivotally or otherwise connected at a rear portion. Such portions may be connected in any manner, completely separable from one another, and/or combinations thereof.

As stated above, there is no requirement for, or against, all portions of the housing being formed of the same type of material. Thus, for example, one portion of the housing may be made of a material that is more wear resistant than another portion, for example, in order to increase the durability of some portion(s).

Although shown attached to the blade carrier which is, in turn, attached to the housing, the mechanism for releasably retaining the blade need not be retained to the housing and/or prevented from becoming separated from the housing when the housing is in the opened state.

Furthermore, although the blades illustrated herein define a trapezoidal shape, each of the various aspects of the present invention may be used in association with blade(s) of any shape and type, for example, but not limited to, blades that define rectangular or parallelogram shapes, blades with squared, rounded or oblique cutting corners, and combinations thereof.

In addition, although the notches in the blades are shown as approximately semi-circular, the notches are not limited to such. For example, a notch may take other shapes and/or configurations in the same or other locations on the blade. In addition, although the blades are shown having two notches, a blade may alternatively have one notch, no notches, or more than two notches.

The actuator may be configured in any of numerous different ways, and may move in any of numerous different ways, that are currently or later become known for purposes of moving the blade carrier and blade between retracted and extended positions, and for releasing a blade from the blade carrier.

Further, although the positionable stop member has been described as a threaded fastener positionable in first and second positions spaced apart from one another and positionable only by opening the housing 20, it will be recognized that the stop member may configured in any of numerous different ways, and may move in any of numerous different ways, that are currently or later become known for purposes of limiting blade travel to a box cutting length. In addition, it is contemplated that such configurations may be incorporated with the actuator or otherwise positionable without having to open the housing.

Thus, while there have been shown and described various embodiments, it will be understood by those skilled in the art that the present invention is not limited to such embodiments, which have been presented by way of example only, and that various changes and modifications may be made without departing from the spirit and scope of the invention. Accordingly, the invention is limited only by the appended claims and equivalents thereto.

What is claimed is:

1. A utility knife comprising:

a housing;

a blade carrier movably mounted to the housing and including a blade supporting surface for supporting a blade, wherein the blade carrier is movable between a retracted position with at least a substantial portion of the blade retracted in the housing, and at least one of (i) a first extended position and (ii) a second extended position with at least a portion of the blade extending outwardly of the housing in the first and second extended positions, the first extended position spaced inwardly towards the housing relative to the second extended position;

an actuator operably connected to the blade carrier and operable to move the blade carrier between the retracted and extended positions to, in turn, move the blade located on the blade carrier between the retracted and extended positions;

a biasing member biasing the blade carrier toward the retracted position; and a stop member positionable at at least (i) a first position on the housing wherein the stop member is engages with the blade carrier and thereby limits extension of the blade carrier and the blade located thereon to the first extended position and (ii) a second position on the housing wherein the stop member is spaced away from the blade carrier to thereby permit movement of the blade carrier and the blade located thereon to the second extended position.

2. The utility knife as defined in claim 1, wherein the first extended position defines a box cutting position of the blade.

3. The utility knife as defined in claim 1, wherein the first extended position corresponds to exposing outwardly of the housing a cutting edge length of the blade within the range of about 0.18 inch and about 0.3 inch.

4. The utility knife as defined in claim 1, wherein the stop member is removably engagable with the housing in both the first and second positions.

5. The utility knife as defined in claim 4, wherein the stop member is disposed within a slot defined by the blade carrier, the slot defines a guide for translation of the blade carrier relative to the housing and a maximum distance of translation of the blade carrier relative to the housing and, the stop member limits the maximum distance of translation when removably disposed within the slot.

6. The utility knife as defined in claim 4, wherein the stop member is a threaded fastener threadedably received in the housing at either the first position or the second position.

7. The utility knife as defined in claim 6, wherein the threaded fastener includes a head disposed within a slot defined by the blade carrier, the slot defines a guide for translation of the blade carrier relative to the housing and a maximum distance of translation of the blade carrier relative to the housing, the head of the threaded fastener limits the maximum distance of translation when removably disposed within the slot.

8. The utility knife as defined in claim 1, wherein the biasing member includes a spring having a first end fixedly secured to the housing and a second end secured to the blade carrier for biasing the blade carrier toward the retracted position.

9. The utility knife as defined in claim 1, wherein the stop member defines a stop surface engagable with at least one of the actuator, the blade carrier and the blade in the first position.

10. The utility knife as defined in claim 1, further comprising an axially-elongated surface defining an axially-elongated slot, and a fastener coupled between the blade carrier and the slot for guiding movement of the blade carrier between the retracted and extended positions.

11. The utility knife as defined in claim 1, further comprising a spare blade holder including a mounting portion connectable to the housing for supporting the spare blade holder thereon, and a blade retaining portion extending from the mounting portion and overlying a cutting edge blade support portion of the housing, wherein the blade retaining portion is flexible to allow it to be manually engaged and flexed away from the cutting edge blade support portion to, in turn, pass a back edge of a spare blade beneath the blade retaining portion with the respective cutting edge supported on the cutting edge blade support portion, and upon release, the blade retaining portion is biased into contact with the back edge of the blade to retain the spare blade between the blade retaining portion and the cutting edge blade support portion.

12. The utility knife as defined in claim 11, wherein the blade retaining portion is configured to receivably clip at least a portion of the back edge defining the blade while the blade support portion receives at least a portion of the cutting edge.

13. The utility knife as defined in claim 12, wherein the cutting edge blade support portion includes two notches configured in corresponding ribs extending from the housing.

14. The utility knife as defined in claim 11, wherein the blades are substantially planar, and the spare blade holder is oriented in the housing such that a blade located in the spare blade holder is oriented oblique to a blade located on the blade carrier.

15. The utility knife as defined in claim 11, wherein the spare blade holder is formed of spring steel.

16. The utility knife as defined in claim 1, wherein the housing includes two separable parts defining a cavity receiving the blade carrier, at least one of the parts is movable relative to the other for opening the housing and accessing the blade carrier, and the blade carrier is secured to at least one of the parts to prevent the blade carrier from falling out upon opening the housing.

17. A utility knife comprising:

a housing defining a blade aperture;

first means for carrying a blade between a retracted position with the blade received within the blade aperture and a fully-extended position with a substantial portion of the blade extending outwardly of the blade aperture;

second means positionable at at least (i) a first position engaging with the first means and to limit translation of the first means and the blade carried thereon to a first extended position spaced inwardly on the housing relative to the fully-extended position, and (ii) a second position on the housing spaced away from the first means for allowing the first means and the blade to be moved to the fully-extended position;

third means operably coupled to the first means for moving the first means between the retracted and extended positions to, in turn, move the blade carried on the first means between retracted and extended positions; and fourth means for biasing the first means toward the retracted position.

18. The utility knife as defined in claim 17, further comprising fifth means for holding spare blades.

19. The utility knife as defined in claim 17, wherein the first means is a blade carrier.

20. The utility knife as defined in claim 17, wherein the first means defines an elongated slot, and the second means is received within the slot preventing translation of the first means to the fully-extended position.

21. A utility knife comprising:

a housing;

a blade carrier movably mounted to the housing and including a blade supporting surface for supporting a blade, wherein the blade carrier is movable between a retracted position with at least a substantial portion of the blade retracted in the housing, and at least one second extended position with at least a portion of the blade extending outwardly of the housing;

an actuator operably connected to the blade carrier and operable to move the blade carrier between the retracted and extended positions to, in turn, move the blade located on the blade carrier between the retracted and extended positions;

a biasing member biasing the blade carrier toward the retracted position;

a stop member positionable at at least (i) a first position on the housing wherein the stop member is engages with the blade carrier and limits extension of the blade to a first extended position which extends the blade from the housing less than in the at least one second extended position, and (ii) a second position on the housing spaced away from the blade carrier to permit movement of the blade and the blade carrier to the at least one second extended position; and a spare blade holder connectable to the housing, the spare blade holder configured to receivably clip a cutting edge and an opposite back edge of each of a plurality of spare blades oriented obliquely relative to the blade located on the blade carrier.

* * * * *